US006698325B1

(12) United States Patent
Sprandel

(10) Patent No.: US 6,698,325 B1
(45) Date of Patent: Mar. 2, 2004

(54) MACHINE FOR SKIVING OR SPLITTING NONMETALLIC PLANAR WORKPIECES

(75) Inventor: Dieter Sprandel, Esslingen (DE)

(73) Assignee: Fortuna Spezialmaschinen GmbH, Weil der Stadt (DE)

( * ) Notice: Subject to any disclaimer, the term of this patent is extended or adjusted under 35 U.S.C. 154(b) by 0 days.

(21) Appl. No.: 09/465,062

(22) Filed: Dec. 16, 1999

(30) Foreign Application Priority Data

Dec. 18, 1998 (DE) ..... 198 58 619

(51) Int. Cl.[7] ..... B26D 7/08; B26D 7/12; C14B 1/18

(52) U.S. Cl. ..... 83/168; 83/871; 83/174.1

(58) Field of Search ..... 83/870, 871, 872, 83/874, 168, 174, 174.1

(56) References Cited

U.S. PATENT DOCUMENTS 3,754,490 A * 8/1973 Sata et al. ..... 83/168
4,401,004 A * 8/1983 Glans et al. ..... 83/871 X
4,441,396 A * 4/1984 Mercier et al. ..... 83/871
4,537,102 A * 8/1985 Balzer ..... 83/168 X
4,727,652 A * 3/1988 Malet et al. ..... 83/168 X
4,813,319 A * 3/1989 Weyand, Jr. ..... 83/168 X
5,964,135 A * 10/1999 Aihara ..... 83/168

FOREIGN PATENT DOCUMENTS

DE 17 38 697 1/1957
DE 3815130 A1 * 11/1989
DE 4101377 A1 * 7/1992

* cited by examiner

*Primary Examiner*—Charles Goodman
(74) *Attorney, Agent, or Firm*—Renner, Otto, Boisselle & Sklar, LLP

(57) ABSTRACT

A machine for skiving or splitting nonmetallic planar workpieces, in particular plastic-coated paper-like workpieces, is disclosed. The machine has a motor-driven moving knife, in particular a bell knife or hoop knife, whose cutting edge moves around a closed loop and has a specific contour. A grinding device for grinding the knife is provided. In order to increase the service life, a cleaning device is provided, which can be displaced towards the cutting edge for removing contaminants adhering to the cutting edge.

20 Claims, 4 Drawing Sheets

MACHINE FOR SKIVING OR SPLITTING NONMETALLIC PLANAR WORKPIECES

BACKGROUND OF THE INVENTION

The invention concerns a machine for skiving or splitting nonmetallic planar workpieces, in particular plastic-coated paper-like workpieces, having a motor-driven moving knife, in particular a bell knife or hoop knife, whose cutting edge has a specific contour and moves continuously around a closed loop; and having a grinding device for grinding the knife.

A skiving machine of the aforesaid kind is known, for example, from DE 41 01 377.

Skiving machines are used, for example, in the shoe industry or pursemaking industry, to create a specific profile on the edges of cut sheets of leather, leather replacement materials, rubber, or plastic. A bell knife made of metallic material, which is cup-shaped and is equipped on its front circumferential edge with a cutting edge, is used for this purpose. The bell knife generally sits directly on the shaft of a high-speed, high-output electric motor, or on a spindle and is driven by a motor via a belt. Because the cutting edge of the bell knife made of metallic material is susceptible to wear, it is necessary to grind the cutting edge, from time to time or continuously, so as to sharpen it. Grinding devices that have corresponding deburring devices, as well as dressing devices for a grinding wheel of the grinding device, are known for this purpose.

A splitting machine is known, for example, from DE 38 15 130 A1.

This splitting machine is a hoop knife splitting machine that is equipped with a knife, in the form of an endless steel hoop, that runs over two belt pulleys, one of which is motor-driven. Since the circulating steel knife is subject to wear, a grinding device is provided with which the hoop knife is intermittently or continuously ground to sharpen it.

A feature common to both machines, i.e. skiving and splitting machines, is therefore the fact that they have a moving knife with a specific cutting edge contour that must be reground from time to time.

Since the contour of the cutting edge and the exact position of the cutting edge or cutting line is critical in terms of the skiving or splitting quality, the designs must be such that a flawless cutting edge contour is guaranteed despite the continuous or intermittent regrinding, and such that the position of the cutting edge or cutting line is exact and predetermined.

The field of application of such machines is gradually expanding, since skiving or splitting operations that earlier were performed principally on planar workpieces made of leather are now also being performed on other types of material.

Such workpieces include, for example, paper-like or board-like materials coated with plastic and/or aluminum foil.

Materials of this kind are used, for example, in the beverage industry. Beverage packages such as, for example, milk cartons or juice cartons are manufactured from plastic-coated board stocks of this kind.

Cut sheets of this kind can easily be coated on both sides with a plastic material that is approved for food contact, for example polyethylene. On the cut edges, however, the paper core material is exposed. In order to process these board materials into sealed beverage cartons, it has become known to equip the edges with, for example, a stepped cut by way of a skiving operation. This involves applying a corresponding stepped cut in the region of one edge of the cut sheet, on one side, using a bell knife of a skiving machine, so that a thinner portion of the board material remains on the rim which is then coated with plastic on only one side. This rim is then folded over itself, specifically over the uncoated side, thus resulting in an edge that is coated with plastic on its continuous peripheral edge as well. By heat-sealing several such folded-over edges to one another, it is then possible to construct a three-dimensional object, for example a parallelepiped or tetrahedron.

In processing such materials with a bell knife, it has been found that a deposit of contaminants, which is highly adherent and is made up predominantly of plastic coating material from the workpieces being processed, gradually accumulates in the region of the cutting edge. In the case of a skiving operation, for example, 560 meters per minute of edge material can be cut or skived.

Since the cutting edge contour of the knife is reground periodically or continuously, the grinding device encounters the adhering contaminants in the region of the contour and removes them as well.

Since these contaminants are made of sticky, viscous materials, they clog up the grinding wheel, so that it quickly becomes unusable. As a result, only relatively short service lives of one to two hours can be achieved, since the grinding device is completely clogged with the plastic materials after only a few grinding cycles.

Since the cutting edge of a bell knife is usually ground only on one side, only the contaminants adhering to that one side can be removed at all by the grinding wheel.

Similar impurity problems can also occur in splitting machines on hoop knives, since they have a similar cutting edge contour and similar problematic deposits can thus occur.

SUMMARY OF THE INVENTION

It is thus the object of the invention to provide a remedy here, and to improve a skiving or splitting machine of the kind cited initially in such a way that long service lives can be obtained for the knife and grinding device.

According to the present invention, the object is achieved in that a cleaning device which can be placed against the contour of the cutting edge, and with which the contaminants adhering to the cutting edge can be removed, is provided, the cleaning device being adaptable to the contour of the cutting edge.

The provision of a separate cleaning device has the considerable advantage that contaminants adhering to the cutting edge can be removed before the grinding device comes into engagement with the knife. This thus prevents the grinding device from quickly becoming clogged with the contaminants and requiring replacement.

The grinding device can then exclusively perform its grinding function, since it encounters a cleaned cutting edge; as a result, long service lives can be obtained for the grinding device, which then also results in long service lives for the knife.

Because the cleaning device is adaptable to the contour of the cutting edge, this contour is not adversely affected, i.e. its geometry is not changed and the cutting edge is cleaned exactly along its contour. This means that there are no remaining residues of contaminants that then are removed by the grinding device and would gradually clog it, which in turn would be detrimental to its service life.

Because the cleaning device is adaptable to the contour of the cutting edge, the grinding device is only just in engagement with the impurities on the cutting edge, and does not adversely affect the contour as such.

It has already been mentioned previously that the contour of the cutting edge is quite critical for the skiving or splitting quality. If residual contaminants were to remain behind, the grinding quality could be negatively influenced thereby, which is undesirable. In the case of thin knives, the geometry of the contour could be changed if the deposit were removed using large forces. The adaptability feature prevents this.

Very long service lives, and thus availabilities of up to 99.85%, can be achieved.

The object is thereby completely achieved.

In a further embodiment of the invention, the cleaning device is displaceable along the contour, transversely to the movement direction of the knife.

The advantage of this feature is that the cleaning device can be arranged and can work, in space-saving fashion, away from the actual working point of the knife on its edge and transversely to its movement direction.

In a further embodiment of the invention, the cleaning device cleans the cutting edge on both sides of its cutting portion.

The advantage of this feature is that the cutting edge is cleaned on both sides, thus continuously ensuring outstanding cutting quality.

If, for example, a knife is always reground only on one side, which is usual in the case of bell knives, the grinding device could in any case clean only one side, so that then when the aforementioned problematic materials are processed, the side opposite this reground side would gradually clog up with contaminants, which in turn would have a disadvantageous effect on grinding quality. During sharpening, a chip is detached from the material and is usually deflected and carried off via a chip deflector in the interior of the bell knife. If an increasingly thick deposit of contaminants then gradually builds up on the inner side of the bell knife, the chip can no longer be detached and carried off in precisely guided fashion.

In a further embodiment of the invention, the cleaning device has cleaning elements that can be guided back and forth along the contour transversely to the movement direction of the knife, and thereby detach contaminants adhering to the contour.

The advantage of this feature is that by way of the selection, number, and arrangement of the cleaning elements, flexible adaptation is possible to the local conditions of the skiving or splitting machine and to the type of contaminants, depending on which contaminant can best be removed by which cleaning element. The cleaning elements can then correspondingly be exchanged or replaced while the configuration of the cleaning device itself remains the same.

In a further embodiment of the invention, each cleaning element has an edge that peels off contaminants adhering to the contour.

This feature has the considerable advantage that the cleaning device operates as a peeling device, i.e. lifts off the contaminants, for example as chips, so that they are then carried off, without causing the cleaning elements of the cleaning device themselves once again to become gradually clogged or sticky.

The result can thus be, for example, that plastic material's adhering firmly to a metal knife are peeled off and carried away as chips.

This not only increases the service life of the knife and the grinding device, but also yields a particularly considerable increase in the service life of the cleaning device, so that the overall result is a long service life for all three of these operating devices. The machine is almost continuously available for operation.

In a further embodiment of the invention, a cleaning element sits at one end of a lever that is pivotable against spring force and that can be pressed by the force of the spring against the contour of the cutting edge.

The advantage of this feature is to ensure, with mechanically simple and robust means, not only that sufficient contact pressure is present to clean the cutting edge, but also that, because of the pivotability of the lever, the cleaning element can be guided exactly and easily along the contour of the cutting edge.

In a further embodiment of the invention, two pivotable levers, which can be placed against opposite sides of the cutting edge, are provided.

The advantage of this feature is that each lever can be guided on its side exactly along the respective contour of the cutting edge on that side, i.e. even if different contours are present, for example in the case of knives that are asymmetrical or are ground on only one side.

In a further embodiment of the invention, a control system is provided which effects placement of the cleaning device against the knife only a certain short distance behind the cutting portion.

The considerable advantage of this feature is to ensure that the cleaning device does not come into contact with the highly sensitive outermost cutting edge which, as already mentioned several times, is indeed critical in terms of skiving or splitting quality. This prevents the cleaning device from bumping against the edge and thereby deforming it. In any case, relatively few contaminants are present directly at the tip, since the latter engages into the solid material without yet lifting a chip. It is in the regions behind the tip, i.e. in a region in which the chip to be detached is already lifting up slightly, that substantially greater volumes of contaminants become deposited over time. The tip is in any case removed in a subsequent grinding operation, and usually the opposite side is also processed in a subsequent deburring operation, so that no continuously occurring accumulation of contaminants is observed directly in the region of the tip.

In a further embodiment of the invention, two two-armed levers that are pivotable about a common lever axis are provided, and a spring, which presses one end of each lever respectively against one side of the knife edge, acts between the axes.

The advantage of this feature is that the two sides of the cutting edges can be cleaned, in a manner adaptable to the respective contours of the cutting edge, by way of physically simple and compact features that are nevertheless independent of one another.

In a further embodiment of the invention, the cleaning device has a linear drive by way of which the cleaning device can be displaced back and forth along the contour transversely to the movement direction of the knife.

The advantage of this feature is that the cleaning device can be moved selectably, i.e. periodically, cyclically, or continuously, back and forth along the contour, specifically transversely to the movement direction of the knife; in the case of skiving machines in particular, this can be embodied in very space-saving fashion.

In the case of splitting machines with long hoop knife travel lengths, it would also be possible to place the cleaning device against the edge in the movement direction, if allowed by the circumstances in terms of space.

It is understood that the features mentioned above and those yet to be explained below can be used not only in the respective combinations indicated, but also in other combinations or in isolation, without leaving the context of the present invention.

SHORT DESCRIPTION OF THE DRAWINGS

The invention will be described and explained in more detail below with reference to a selected exemplary embodiment in conjunction with the appended drawings, in which.

DETAILED DESCRIPTION OF THE PREFERRED EMBODIMENT

Figure 1:
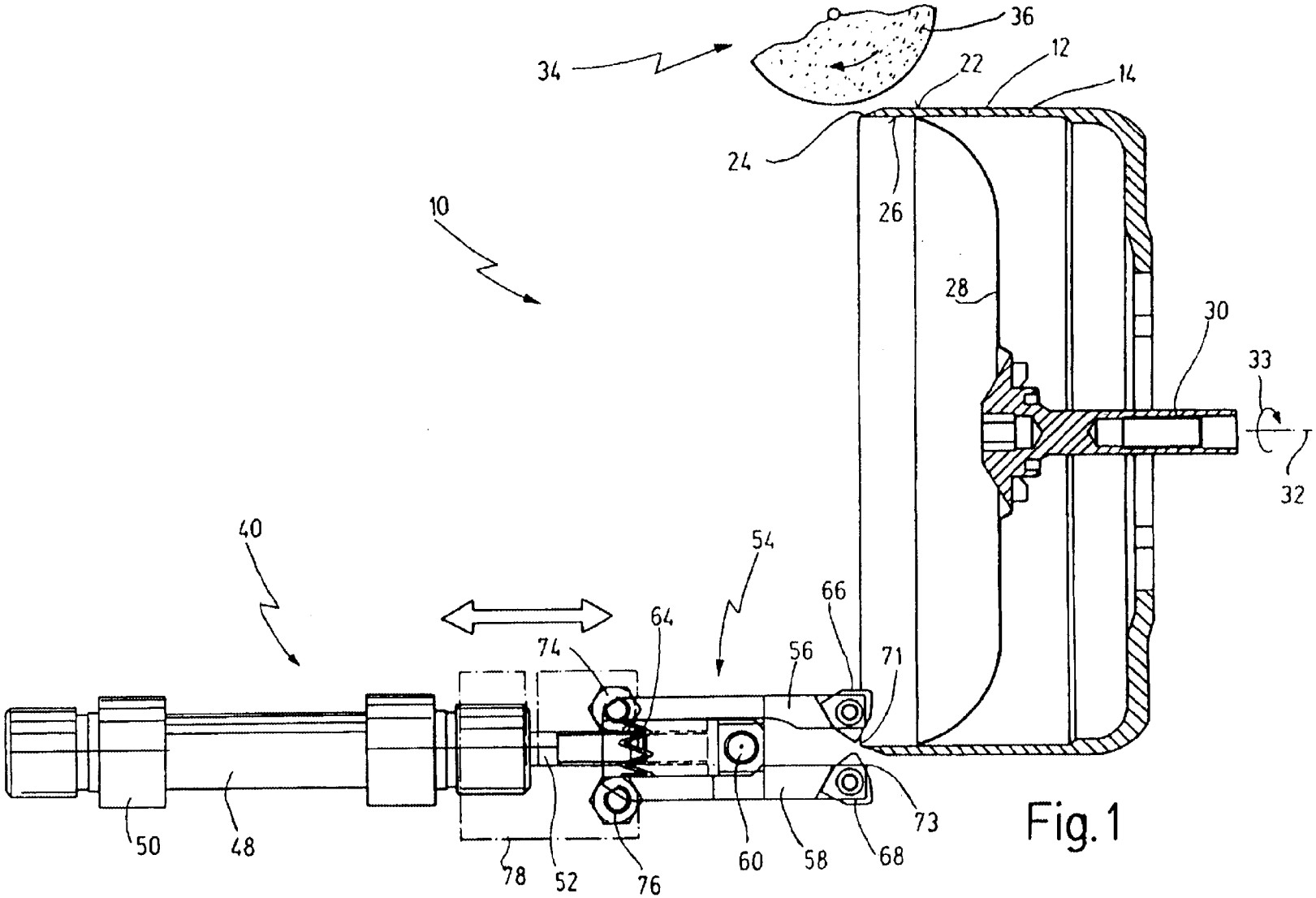
FIG. 1 shows, in highly schematic fashion, a plan view of an exemplary embodiment of a skiving machine, only the bell knife, the grinding device, and the cleaning device according to the present invention being shown in order to simplify the representation.
Figure 2:
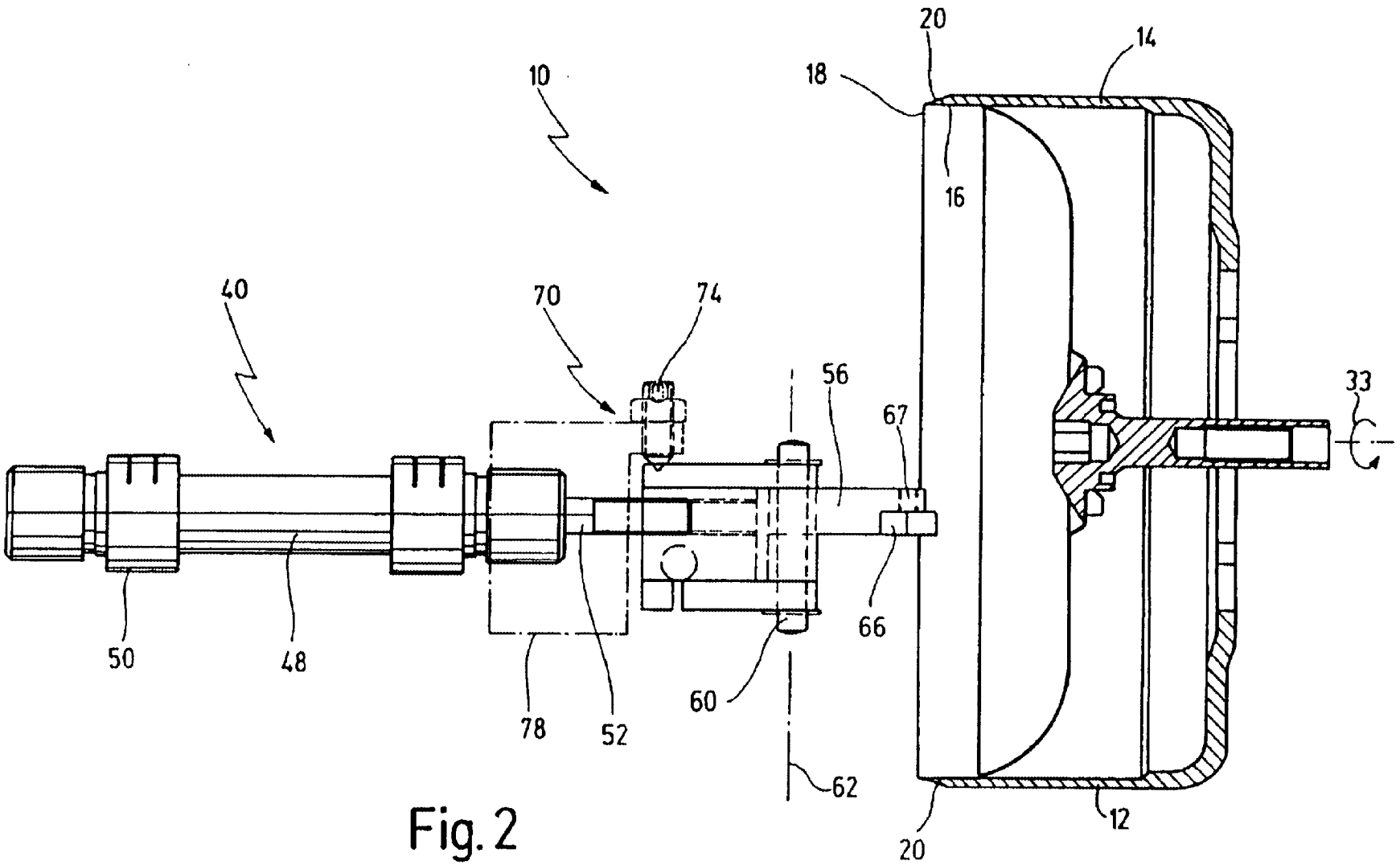
FIG. 2 shows a side view, rotated 90° with respect to FIG. 1, of the skiving machine of FIG. 1 without the grinding device.

In FIGS. 1 through 5, a skiving machine 10 is labeled in its entirety with the reference number 10.

Skiving machine 10 has a knife 12 that is configured as a bell knife 14.

Bell knife 14 has on its exposed outer circular periphery a cutting edge 16.

The outermost tip of cutting edge 16 forms a circular edge.

Cutting edge 16 has a specific contour 20. Cutting edge 16 is ground down only from one side—in this case from outer side 22—and therefore has on that side 22 a curved contour 24 that corresponds to the circumferential line of a grinding wheel 36 of a grinding device 34, as shown in FIG. 1. On inner side 26, contour 20 of cutting edge 16 runs in a straight line. A chip deflector 28, as known per se, is mounted in the interior of bell knife 14, specifically on a retaining stem 30 that is joined to a drive (not shown here) for bell knife 14.

The longitudinal center axis of retaining stem 30 is thus the drive or rotation axis 32 of the bell knife, as indicated by an arrow 33.

The further usual components of a skiving machine, for example an advance roller arranged in the interior of the bell knife and a corresponding foot, are not shown here for the sake of clarity; reference is made in this context, for example, to the configuration of the aforesaid DE 41 01 377 A1.

A cleaning device 40 according to the present invention, arranged to the side and in front of bell knife 14, is arranged in, skiving machine 10.

Figure 3:
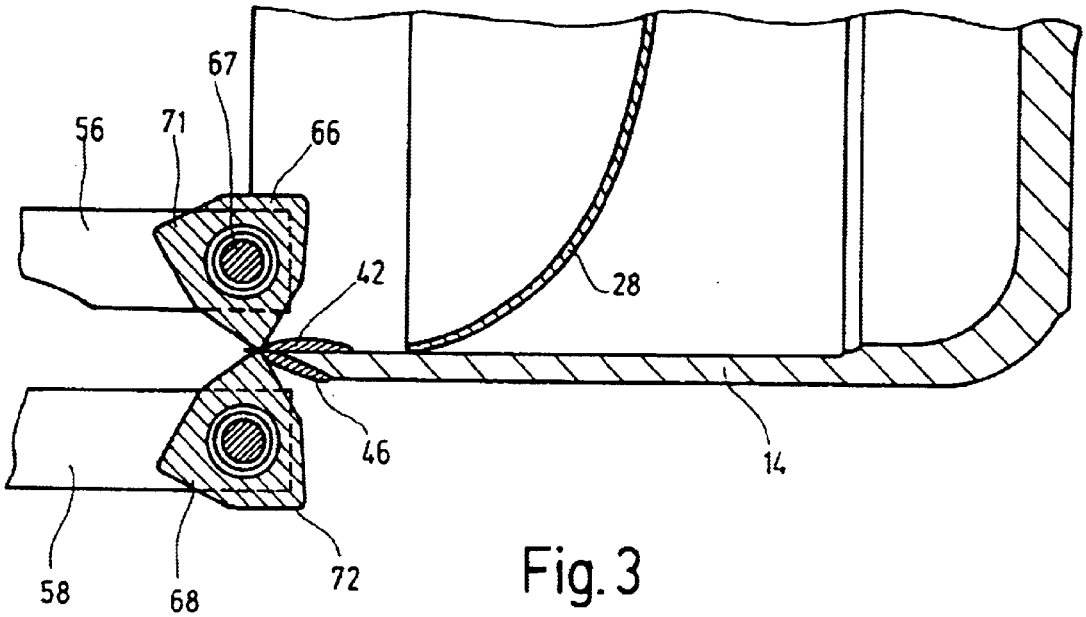
FIG. 3 shows a greatly enlarged portion of the representation of FIG. 1 with the cleaning device in an initial working state.
Figure 4:
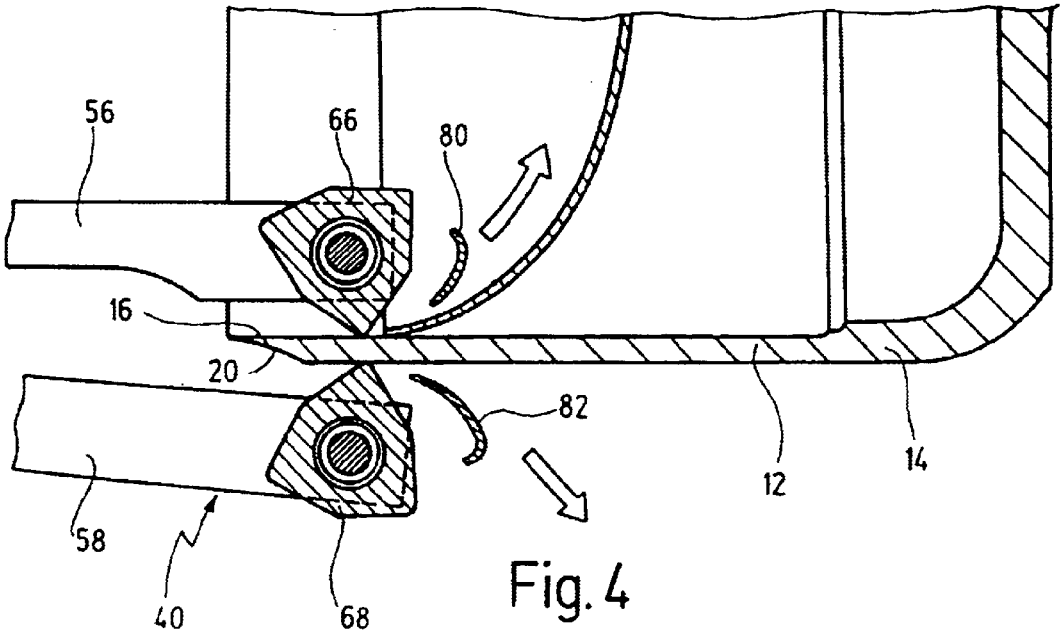
FIG. 4 shows a representation, corresponding to the one in FIG. 3, of a further operating position of the cleaning device.
Figure 5:
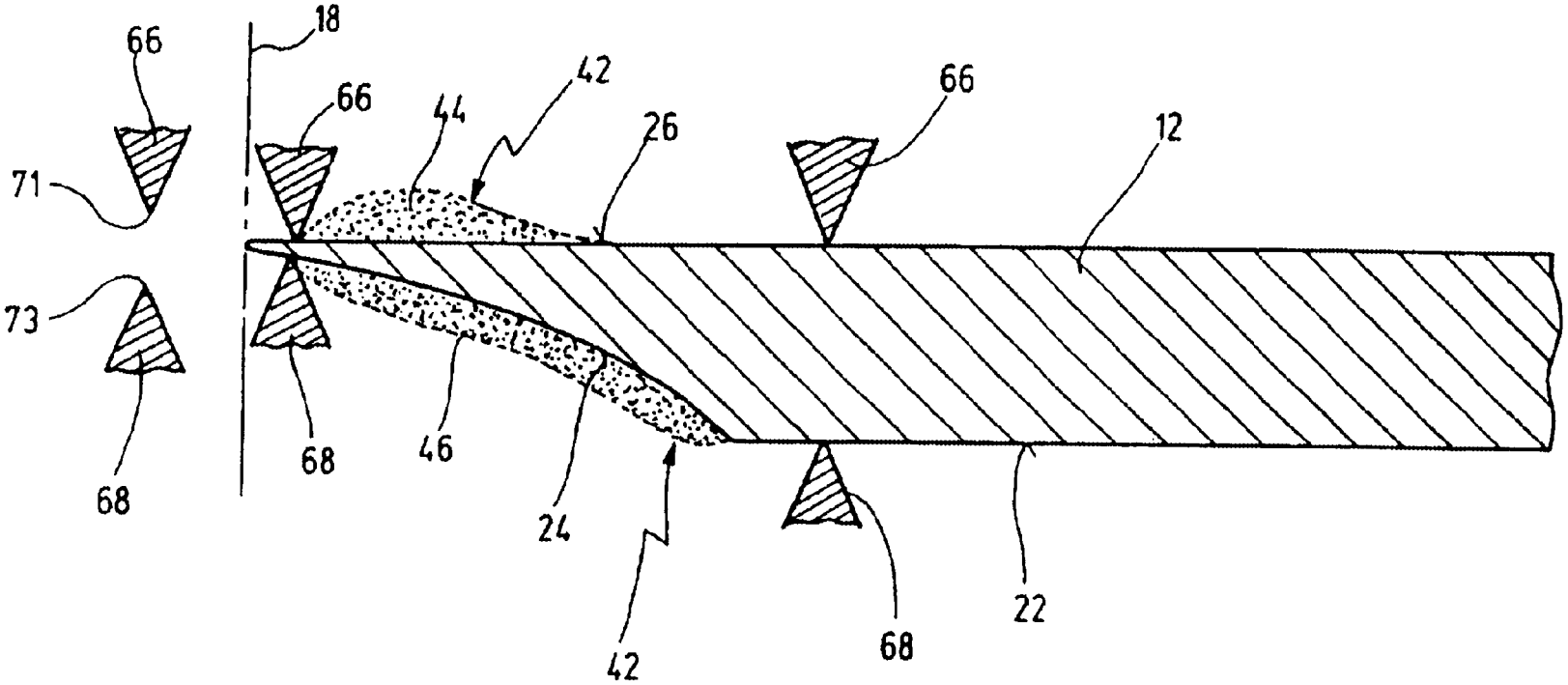
FIG. 5 shows an partial, even further enlarged, and highly schematic representation of the various working positions of the cleaning elements of the cleaning device shown in FIG. 1.

Cleaning device 40 serves to remove contaminants 42 that have become deposited in the region of cutting edge 16 on both sides as deposit 44 and 46 (see especially FIGS. 3 through 5).

Cleaning device 40 has for this purpose a linear drive 48 that is constructed as a pneumatic cylinder 50.

The corresponding connection and supply elements are not shown for the sake of clarity.

A piston rod 52 of pneumatic cylinder 50 carries a cleaning unit 54.

Cleaning unit 54 has a first two-armed lever 56 and a second two-armed lever 58.

The two levers 56, 58 are pivotable about a common pivot pin 60, so that its longitudinal center axis 62 represents the pivot axis of both levers 56 and 58.

Arranged between the rear ends (which face toward pneumatic cylinder 50) of levers 56 and 58 is a compression spring 64 that pushes those two lever ends away from one another.

Cleaning elements 66 and 68 are arranged on the outer end of levers 56 and 58 at the end located opposite compression spring 64, i.e. on the other side of pivot axis 62.

Cleaning elements 66, 68 are configured as roughly triangular plates that each have edges 71 and 73 extending in the circumferential direction of cutting edge 16 of bell knife 14. The length of edges 71, 72 is a few millimeters, as is evident from the side view of FIG. 2.

Edges 71, 72 are then slightly curved, corresponding to the radius of curvature of bell knife 14.

Each cleaning element 66, 68 is mounted immovably via a screw 67 on the outer end of the corresponding lever 56, 58.

A control system 70, which serves to adjust the lifting travel of levers 56, 58, is provided; this is accomplished by way of two adjusting screws 74 and 76 that are attached to a stationary mount 78.

The contour of levers 56 and 58, and the adjusting screws 74 and 76 in engagement with them, are such that edges 71 and 73 of cleaning elements 66 and 68 are initially lifted slightly away from cutting edge 16, as is evident in FIG. 1. This position is apparent in the enlarged representation of FIG. 5 at the far left side. Actuation of linear drive 48 then causes cleaning elements 66 and 68 to be displaced to the right in the presentation of FIGS. 1 and 5, specifically until they have moved approximately 0.5 to 1 mm behind the outer cutting edge 18. Levers 56, 58 have now traveled over adjusting screws 74 and 76 of control system 70 to a point such that compression spring 64 presses the lever ends apart. Cleaning elements 66 and 68 are thereby pressed against the corresponding sides of cutting edge 16. Edge 71 of cleaning element 66 is placed against side 26, i.e. against the straight side of cutting edge 16. Cleaning element 68 is correspondingly placed, via its edge 73, against contour 24 of cutting edge 16, curved in accordance with grinding wheel 36. This position is visible in FIG. 3, and in FIG. 5 is the middle position of cleaning elements 66 and 68.

When pneumatic cylinder 50 is then actuated again, edges 71 and 73 of cleaning elements 66 and 68 travel along the contour of cutting edge 16 and thereby remove contaminant 42, i.e. the respective deposits 44 and 46 on either side of cutting edge 16. This removal is accomplished in the manner of a chip, as is shown in FIG. 4 by chips 80 and 82, which are then carried off to the side as indicated therein by arrows. The position of cleaning elements 66 and 68 in FIG. 4 corresponds to the right side of the schematic representation of FIG. 5.

Because of the lever configuration, lever 58 can thus exactly follow the curved contour 24 of cutting edge 16, and lever 56 correspondingly follows the contour on the other side in a straight line. This ensures that exact individual adaptation to the cutting contour is accomplished automatically, and that the contaminants can thus be removed precisely. Back-and-forth displacement of pneumatic cylinder 50 causes contaminants 42 to be removed from the rotating bell knife 14 over its entire circumference.

Flawless cleaning is thus possible, either continuously or intermittently depending on the operating mode.

After the cleaning device has been retracted, a grinding operation with subsequent deburring can then be performed.

What is claimed is:

1. A machine for skiving or splitting nonmetallic planar workpieces, said machine comprising:

a knife having a cutting edge of a specific contour that is movable continuously around a closed loop;

a grinding device for grinding the cutting edge;

a cleaning device comprising at least one cleaning element having a cleaning edge corresponding to the contour of the cutting edge, the cleaning edge being engageable with the cutting edge for removing contaminants adhering to the cutting edge, wherein said cleaning device comprises two cleaning elements having cleaning edges respectively for engaging the cutting edge on both sides.

2. The machine as defined in claim 1, wherein said cleaning device comprises a drive mechanism for supporting and displacing said cleaning elements for moving the cleaning edges along the contour of the cutting edge, transversely to said closed loop.

3. The machine as defined in claim 2, further comprising a lever supporting said cleaning element at one end thereof and a spring exerting a spring force against said lever, said lever being arranged pivotably against said spring force towards said cutting edge.

4. The machine as defined in claim 2, wherein said drive mechanism is configured as a linear drive for displacing said cleaning elements back and forth across said cutting edge transversely to the closed loop.

5. The machine as defined in claim 1, comprising a drive for moving said cleaning element back and forth along the contour transversely to the closed loop.

6. The machine as defined in claim 1, further comprising two levers arranged at opposite sides of said cutting edge pivotably towards said cutting edge, each of said levers supporting one of said cleaning elements at one end thereof, a spring being provided between said two levers exerting a spring force against which each of said levers is pivotable.

7. The machine as defined in claim 6, wherein said two levers are arranged pivotably about a common lever axis, said spring being arranged between said two levers for biasing said cleaning edges against each other.

8. The machine as defined in claim 1, further comprising a control system for controlling movement of said cleaning elements.

9. The machine as defined in claim 8, wherein said control system is configured to press said cleaning edge of at least one cleaning element against said knife a certain distance behind said cutting edge.

10. The machine as defined in claim 1, wherein said cutting knife is configured as a bell knife.

11. The machine as defined in claim 1, wherein said cutting knife is configured as a hoop knife.

12. A machine for skiving or splitting nonmetallic planar workpieces, said machine comprising:

a knife having a cutting edge of a specific contour that is movable continuously around a closed loop;

a grinding device for grinding the cutting edge;

a cleaning device comprising at least one cleaning element having a cleaning edge corresponding to the contour of the cutting edge, the cleaning edge being engageable with the cutting edge for removing contaminants adhering to the cutting edge, comprising a drive for moving said at least one cleaning element back and forth along the contour transversely to the closed loop.

13. The machine as defined in claim 12, wherein the cleaning edge of each cleaning element is biased against said cutting edge for peeling off contaminants adhering thereto.

14. The machine as defined in claim 12, wherein said cleaning device comprises a drive mechanism for supporting and displacing said at least one cleaning element for moving the cleaning edge along the contour of the cutting edge, transversely to said closed loop.

15. The machine as defined in claim 14, further comprising a lever supporting said cleaning element at one end thereof and a spring exerting a spring force against said lever, said lever being arranged pivotably against said spring force towards said cutting edge.

16. The machine as defined in claim 14, wherein said drive mechanism is configured as a linear drive for displacing said cleaning element back and forth across said cutting edge transversely to the closed top.

17. The machine as defined in claim 12, further comprising a control system for controlling movement of said at least one cleaning element.

18. The machine as defined in claim 17, wherein said control system is configured to press said cleaning edge of at least one cleaning element against said knife a certain distance behind said cutting edge.

19. The machine as defined in claim 12, wherein said cutting knife is configured as a bell knife.

20. The machine as defined in claim 11, wherein said cutting knife is configured as a hoop knife.

* * * * *